US005961205A

United States Patent [19]

Lovell

[11] Patent Number: 5,961,205

[45] Date of Patent: Oct. 5, 1999

[54] REMOVABLY MOUNTABLE LIGHT FOR WALL AND CORNER

[76] Inventor: Allan R. Lovell, 545 King Edward St., Winnipeg, Manitoba, Canada, R3H 0N9

[21] Appl. No.: 08/788,572

[22] Filed: Jan. 24, 1997

[51] Int. Cl.[6] ..... F21V 7/18

[52] U.S. Cl. ..... 362/306; 362/147; 362/396; 362/341; 362/370

[58] Field of Search ..... 362/147, 362, 362/368, 306, 341, 370, 396, 432

[56] References Cited

U.S. PATENT DOCUMENTS

| | | | |
|---|---|---|---|
| 752,959 | 2/1904 | Currier | 362/368 |
| 1,910,062 | 5/1933 | Schepmoes | 362/147 |
| 2,640,670 | 6/1953 | Lampe . | |
| 4,217,629 | 8/1980 | Russell . | |
| 4,246,629 | 1/1981 | Marrero | 362/147 |
| 4,338,653 | 7/1982 | Marrero | 362/147 |
| 4,352,151 | 9/1982 | Lewis . | |
| 4,590,544 | 5/1986 | Decandia | 362/368 |
| 4,600,975 | 7/1986 | Roberts | 362/368 |
| 4,862,333 | 8/1989 | Brasket | 362/147 |
| 5,057,980 | 10/1991 | Russell . | |
| 5,113,328 | 5/1992 | Foster et al. | 362/362 |
| 5,142,466 | 8/1992 | Foster et al. | 362/368 |
| 5,251,118 | 10/1993 | Budnovitch et al. . | |
| 5,297,011 | 3/1994 | Triunfol . | |
| 5,349,134 | 9/1994 | Russell . | |
| 5,562,340 | 10/1996 | Lovell | 362/147 |

FOREIGN PATENT DOCUMENTS

| | | | |
|---|---|---|---|
| 9113287 | 9/1991 | WIPO | 362/147 |

*Primary Examiner*—Laura Tso
*Attorney, Agent, or Firm*—R. W. B. Bailey

[57] ABSTRACT

A light canister may be removably mounted either on protruding and typically exterior building corners, or flat walls. A vertical groove accommodates the corner, support brackets and hooks inside the groove to engage the support bracket. The bracket has two corner contact plates connected by a protruding connection forming a space between the wall and itself when the bracket is attached. The hooks are dimensioned to fit snugly within the space and are conveniently V shaped. Spring clips on the canister can engage vertical cylindrical bars fitted to a flat wall, or vice versa. A builtin electrical plug directly engages a wall mounted plug. Triple internal reflectors, two adjustable allow the light to be directed at will.

20 Claims, 4 Drawing Sheets

REMOVABLY MOUNTABLE LIGHT FOR WALL AND CORNER

This invention relates to removably mountable lights wall and corner and support brackets, and kits therefor. Outward protruding corner lights, support brackets and support bracket kits therefor are described in U.S. Pat. 5,562,340, issued Oct. 8, 1996 to Lovell, instant applicant, which is herein incorporated by reference. Generally such a protruding corner is external to a building or structure, and the lights and bracket are so designed, such a protruding corner may be internal to a building or structure and as those skilled in the art would appreciate, such corner lights and brackets may be utilized on protruding internal corners. These light canisters mountable on outward protruding corners, support brackets and support brackets kits therefor, are known to provide suitable easily removable weatherproof lights.

The advantage of easily removable lights mountable om walls and corners lies in their maintenance, since they do not have to be worked on in position outside, but can be removed, maintained and then remounted.

It is also desirable to provide suitable easily removable lights for flat surfaces and adjustable reflectors and systems thereof for light canisters. When a canister is designed to be mounted in a fixed position relative to a substrate, it is often desirable to direct the light from the canister in a specific direction, which may be suitably achieved by adjustable reflector means within the canister. While this system is especially suitable for light canisters of the type described herein, as would be appreciated by those skilled in the art it is not limited thereto, and may be used in other light canisters.

No such reflector systems for light canisters are readily available, and obviously it is convenient to be able to adjust the direction of light from canisters, especially those mounted on wall corners.

The present invention contemplates a reflector system for light canisters, having a light bulb or tube and lens and reflector means on the side of the bulb or tube away from the lens. The reflector means includes pivotable reflector means which can be moved so as to change the direction of light reflected from the reflector means. It further contemplates means to mount the light canister not only on an outward protruding corner, using bracket means but also means to mount the canister on a flat surface. It further contemplates a canister mounted plug having a substantially flat front face basically coplanar with the canister surface to engage wall plug means.

Although the invention will be described and referred to specifically as it relates to light canisters having therein a vertically extending right angled groove to accommodate protruding corners, wall mountable brackets attachable to protruding corners, and hooks attachable within the groove to engage the brackets, and to light canisters having therein light bulb or tube, lens and pivotable reflector means, and to light canisters having clips to engage wall mounted bars, and light canisters having bars thereon to engage wall clips, and plug means having a surface coplanar with the light canister backpiece, it will be understood that the principles of this invention are equally applicable to similar devices and accordingly, it will be understood that the invention is not limited to such devices.

BACKGROUND OF INVENTION

External corner lighting is desirable so that a light mounted on a corner or wall can illuminate evenly, typically in the 270° arc around an exterior right angled corner, or the 180° arc around a wall. Another requirement is that the light generating lamp, bulb or tube be easily changeable. This is most easily done by having the canister removable from the corner, otherwise the canister must be taken apart in place, which is generally inconvenient. By having mounting brackets attached around the corner or to the wall and detachably mounting the canister thereon, the canister is made removable. A vertical groove enables the canister to fit the corner more snugly and thus reduces any play caused by wind and weather. Hooks mounted within the canister grooves engage gaps formed between corner and mounting brackets. The close symmetrical mounting of the canister on the corner provides photometrically even lighting from the light or luminaire. Similarly clips mounted on the canister can engage bars mounted on the wall, or bars on the canister may engage clips on the wall, again the canister is closely and symmetrically mounted on the wall providing photometrically even lighting. Equally it may be desirable to direct the light only or chiefly in a specific chosen direction so as to illuminate a specific sector or zone. There is thus a need for the reflector means within the canister to be adjustable.

PRIOR ART

U.S. Pat. No. 2,640,670, 4,217,629, 4,352,151, 5,057,980, 5,251,118, 5,297,011 and 5,349,134, all teach corner attached lighting, of these 2,640,670, 5,251,118 and 5,297,011 teach lighting attached to protruding corners. Applicant is not aware of any close relevant reflector prior art.

It is a primary object of the invention to provide removable corner mounted light canisters. It is a further primary object to provide mounting brackets attachable to both corner walls forming a gap abutting the corner. It is a further primary object to provide a vertically extending groove in the canister. It is a further primary object to provide hooks attachable to the canister groove, which are engageable in the mounting bracket gap when the brackets are mounted on the wall. It is a primary object of the invention to provide removable flat wall mounted light canisters. It is a further primary object to provide mounting bars on the flat wall engaging spring clips on the canister. It is another primary object to provide spring clips on the flat wall engaging mounting bars on the canister. It is a further object to provide both corner mounting hooks in a canister groove and wall mounting spring clips on the same canister. It is another primary object of the invention to provide adjustable reflector means in light canisters. It is a further primary object to provide reflector means pivotable about an axis within the canister. It is a subsidiary object to provide reflector means movable radially with respect to an axis within the canister. It is a further subsidiary object to provide fixed reflector means within the canister. It is a further subsidiary object to provide two reflector means pivotable about an axis within the canister. It is a further subsidiary object to provide two reflector means movable radially with respect to an axis within the canister. It is a further primary object to provide a plug lacking any external cord on the canister exterior to engage a socket or plug attached to or built into the opposed corner or wall. Other objects will be apparent to those skilled in the art from the following specification and accompanying drawings and appended claims.

DESCRIPTION OF THE INVENTION

In one broad aspect the invention is directed to an improved light canister having top end means, bottom end means and backpiece means connecting the top and bottom end means. The improvement provides adjustable reflector means pivotally mounted in the top and bottom end means. Preferably the adjustable reflector means comprises upper and lower tongue means extending toward the middle of the canister. Both tongue means have therein longitudinal slot means overlapping an axis passing substantially through the middle of the top and bottom end means. Upper and lower loosenable fastening means pass through the slot means and engage the top and bottom end means, substantially along the axis. Conveniently these fastening means are screw means. Preferably the adjustable reflector means comprises reflecting surface means of concave horizontal cross section. Typically there are provided paired adjustable reflector means, each of which has upper and lower tongue means. Fixed reflector means are usually interior and adjacent the backpiece means, with reflecting surface means of biconcave horizontal cross section, conveniently the fixed reflector means extends between the top and bottom end means, substantially of the same dimension as the backpiece means, subtending a horizontal angle of approximately a right angle to the canister axis. Similarly the paired adjustable reflector means extend from adjacent the top end means to adjacent the bottom end means, each adjustable reflector means subtends a horizontal angle of approximately a right angle to the canister axis. This light canister may embody canister plug means comprises substantially flat front surface means, the front surface means being substantially coplanar with the canister backpiece means and the plug front surface means has projecting therefrom a plurality of male electrical connector prong means to engage matingly female electrical connector socket means of the wall plug means, mechanically and electrically. It can also embody releasable attachment means comprising a plurality of horizontal spring clip means mounted on the canister to engage releasably a plurality of vertical bar means mounted on the flat wall means, which may be cylindrical and have circumferential grooves to engage the spring clip means.

In another broad aspect the invention is directed to a light canister having top end means, bottom end means and backpiece means connecting the top and bottom end means, and canister plug means to engage wall plug means, the canister plug means having substantially flat front surface means, the front surface means being substantially coplanar with the canister backpiece means. Preferably the plug front surface means has projecting therefrom a plurality of male electrical connector prong means to engage matingly female electrical connector socket means of the wall plug means, mechanically and electrically. Conveniently the backpiece means includes groove means extending vertically when the canister means is mounted vertically, the groove means having mounted therein hook means to engage bracket means mounted on a protruding corner. It may comprise releasable attachment means mounted on the backpiece means to releasably engage attachment means on flat wall means. Both groove means and releasable attachment means may be present.

In a further broad aspect the invention is directed to a light canister having top end means, bottom end means and backpiece means connecting the top and bottom end means, and releasable attachment means mounted on the backpiece means to releasably engage attachment means on flat wall means. Preferably the releasable attachment means are selected from the group consisting of a plurality of horizontal spring clip means mounted on the canister to engage releasably a plurality of vertical bar means mounted on the flat wall means, and a plurality of vertical bar means mounted on the canister to engage releasably a plurality of horizontal spring clip means mounted on the flat wall means. Preferably the releasable attachment means comprises a plurality of horizontal spring clip means mounted on the canister backpiece to engage releasably a plurality of bar means mountable vertically on the flat wall means, which may be cylindrical and may have circumferential grooves to engage the spring clip means. The backpiece means may comprise groove means extending vertically when the canister means is mounted vertically, the groove means having mounted therein hook means to engage bracket means mounted on a protruding corner. A kit is provided to mount a such light canister comprising a light canister for removably mounting on a flat wall, which has top wall means, bottom wall means, vertical backpiece means having top and bottom edges and opposed side edges, the backpiece means connecting the top and bottom wall means, and a plurality spring clip means, a plurality of bar means to engage releasably the plurality of spring clip means, the bar means being circumferentially grooved to receive the spring clip means. This kit preferably has a light transmitting lens means extending between and contacting the top and bottom wall means and the side edges of the backpiece means, and light source means within the canister. The backpiece means preferably comprises groove means extending vertically when the canister means is mounted vertically. The kit preferably includes hook means adapted to be mounted in the groove means. Conveniently with the hook means are included bracket means to removably mount the light canister on a protruding corner. The bracket has first and second corner contact plate means for the corner and interconnecting means having end portions protruding outward from the first and second plate means, and a midportion spaced apart from the first and second plate means, so when the first and second plate means contact the corner the interconnecting means forms a space between the interconnecting means and the corner. The hook means have a dimensional cross section to engage the space. The canister preferably comprises paired adjustable reflector means pivotally mounted in the top and bottom end means. These adjustable reflector means have reflecting surface means of concave horizontal cross section and upper and lower tongue means extending toward the middle of the canister. Both tongue means have therein longitudinal slot means overlapping an axis passing substantially through the middle of the top and bottom end means, and upper and lower screw means passing through the slot means and engaging the top and bottom end means. There are preferably fixed reflector means interior and adjacent the backpiece means having reflecting surface means of biconcave horizontal cross section. The fixed reflector means extends between the top and bottom end means, substantially of the same dimension as the backpiece means, and subtends a horizontal angle of approximately a right angle to the axis. The paired adjustable reflector means extend from adjacent the top end means to adjacent the bottom end means, each the reflector means subtending a horizontal angle of approximately a right angle to the axis. Preferably canister plug means to engage wall plug means are provided, with substantially flat front surface means, which is substantially coplanar with the canister backpiece means and has projecting therefrom a plurality of male electrical connector prong means to engage matingly female electrical connector socket means of the wall plug means, mechanically and electrically. Preferably a plurality of horizontal spring clip means are mounted on the canister backpiece to engage releasably a plurality of bar means mountable vertically on the flat wall means. A plurality of cylindrical bar means are mountable vertically on the flat wall means, the bar means being circumferentially grooved to receive the spring clip means are also included in the kit.

The groove means in the backpiece, described above extend vertically when the canister means is mounted vertically. The groove means has mounted therein hook means. Typically the groove means is of right angled cross section. Preferably the hook means comprises groove contact plate means attached internally of the groove means. Flange means extend into the groove means from a first edge abutting the groove contact plate means to a second edge spaced apart from the groove contact plate means. Tab means extend along the groove means from the second edge means away from the groove contact plate means. Preferably the groove contact plate means comprises first and second groove contact plate means conjoined at right angles, abutting the groove means. The flange means extends into the groove means at right angles to both the groove contact plate means, forming an L shape. The tab means comprises first and second tab plate means conjoined at right angles to each other and the L shaped flange. Conveniently the first and second groove contact plate means comprise attachment aperture means. Bracket means are supplied to removably mount the light canister on a protruding corner comprising first and second corner contact plate means for the corner and bracket connecting means connecting the first and second corner contact plate means and protruding outward therefrom so that when the first and second corner contact plate means contact the corner the connecting means forms a space between the bracket connecting means and the corner. The hook means has a dimensional cross section to engage the space. Preferably the groove means has mounted therein the hook means. Assembled the bracket means is mounted on the protruding corner, and the hook means engages the space.

The light canister having top end means, bottom end means and backpiece means connecting the top and bottom end means, and adjustable reflector means pivotally mounted in the top and bottom end means, optionally may have canister plug means to engage wall plug means, the plug means having substantially flat front surface means, which are substantially coplanar with the canister backpiece means; further it may optionally have releasable attachment means mounted on the backpiece means to releasably engage attachment means on flat wall means: also it may optionally have backpiece means comprising groove means extending vertically when the canister means is mounted vertically, the groove means having mounted therein hook means to engage bracket means mounted on a protruding corner. Combinations of the light canister with adjustable reflector means with any two, or all three of the canister plug means, and groove and hook means, and releasable attachment means are feasible.

DESCRIPTION OF THE PREFERRED EMBODIMENTS

Figure 1:
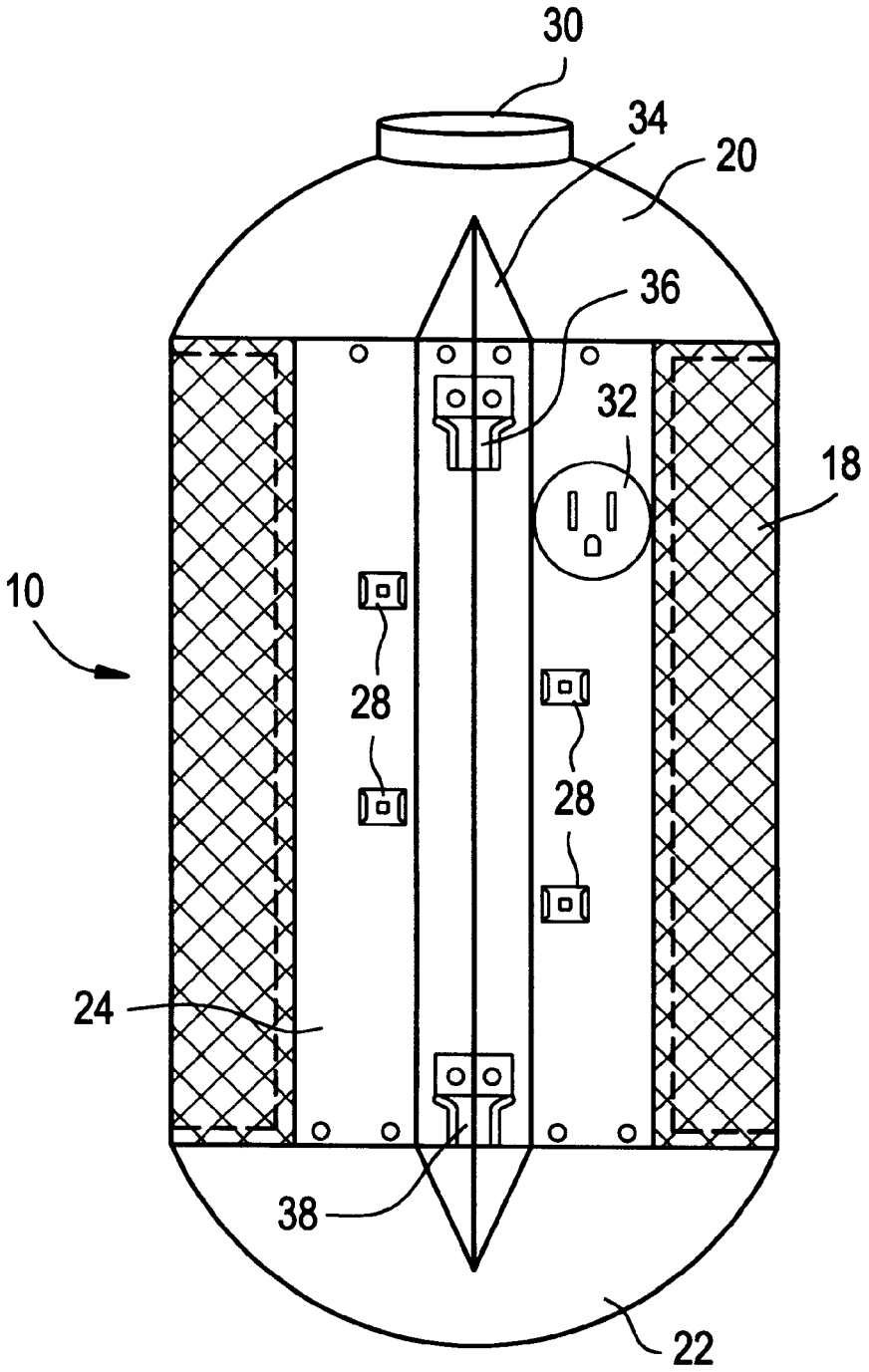
FIG. 1 shows a rear elevational view of a light canister of the invention.

In the drawings numeral 10 generally indicates light canisters of the invention, in FIG. 1, canister 10 includes acrylic lens 18, top end cup 20, bottom end cup 22, backpiece 24, photoelectric cell plugin 30, and power plug 32. Backpiece 24 includes vertically extending right angled groove 34, in groove 34 are mounted upper mounting prong or hook 36 and lower mounting prong or hook 38, which engage wall brackets. Groove 34 extends upward into upper end cup 20 and downward into lower end cup 22. Photoelectric cell plugin 30 is mounted in upper end cap 20, while power plug 32 is mounted in backpiece 24 outside groove 34. Paired spring clips 28 are mounted on either side of groove 34 to receive bars mounted on a flat wall. The light canisters come in a range of sizes currently intended for 35–70 watts, 70–100 watts, 100–150 watts, and 150–400 watts, and apart from dimensional differences are very closely similar, the canisters being about 5, 6, 7½ and 12 inches in diameter respectively, while their heights vary from about 13 inches up to 16 inches. As those skilled in the art would realize, if the light and suitable ballast generate too much heat then either the light power output is reduced or the canister size enlarged. Suitable canisters can be designed within the general structural limitations shown to accommodate lights of various outputs over a wide range. Two wall brackets and paired associated prongs or hooks are found desirable to fix the canister in place so that it is not easily moved by wind and weather. The canister groove 34 has been found to be effective at 1 inch depth along the side for most purposes, smaller versions have depths of about ½ inch along the side.

The advantage of the corner mounted canister is to save energy and installation and fixture costs, by providing double duty service lighting both sides of a building or structure using a single fixture rather than the conventional two fixtures. It is preferred to use a high pressure sodium fixture, which produces about twice as much light output as mercury at the same wattage. Further the decline of high pressure sodium light output declines to a lesser extent than that of mercury, the decline being about half for lights of equal power over the same period. Another advantage is that high pressure sodium lights will relight typically about ½ to 1 minute after being tripped off due to a voltage surge, while mercury lights will relight typically in 4 to 5 minutes. Preferably power plug 32 is wired for 120 volts supply, although as those skilled in the art would appreciate other power supply voltages can be utilized.

Prong or hook or hanger 36 has canister attachment plates 46 and 48 attached within groove 34, horizontal flange 50, and downward flange 52, which engages bracket 14 in space 54. Bracket 14 has wall attachment plates 56 and 58, which abut wall 12, projecting walls 60 and 62, and space forming walls 64 and 66. When mounted horizontal flange 50 rests on space forming walls 64 and 66, while downward flange 52 fits space 54 fairly snugly. Screws or bolts 68 and 70 are used to attach bracket 14 to wall 12.

Figure 2:
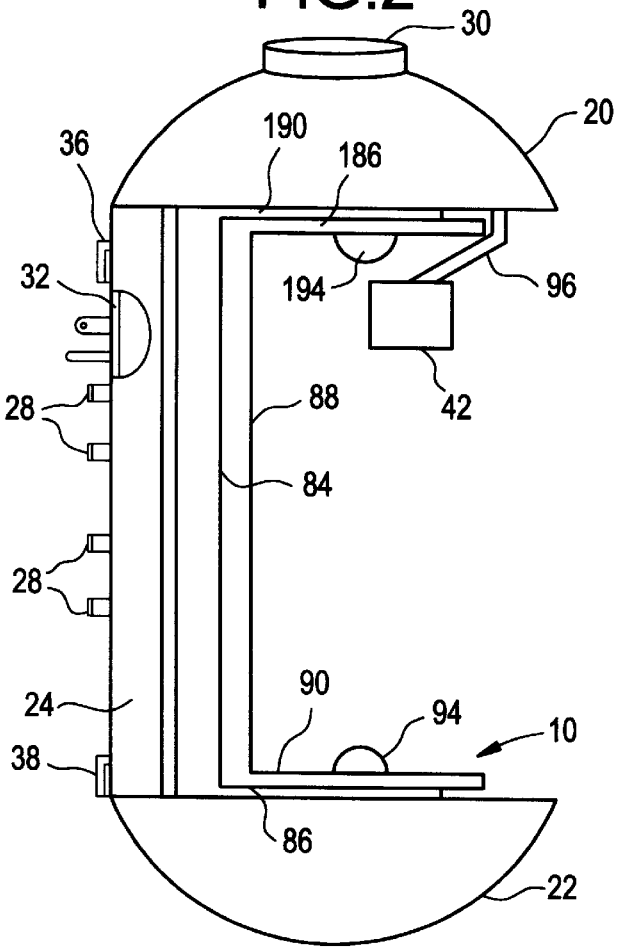
FIG. 2 shows a side elevational view of the embodiment of FIG. 1.
Figure 7:
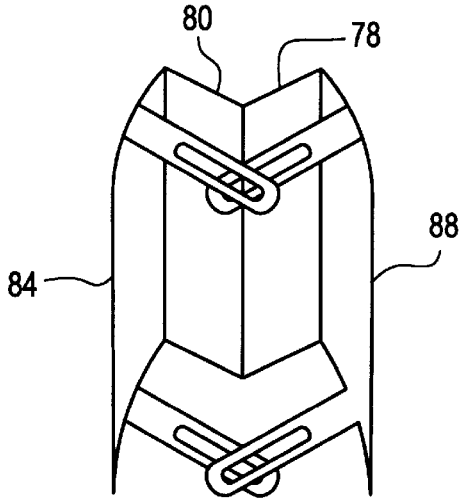
FIG. 7 shows an exploded front view of the embodiment of FIG. 1.
Figure 3:
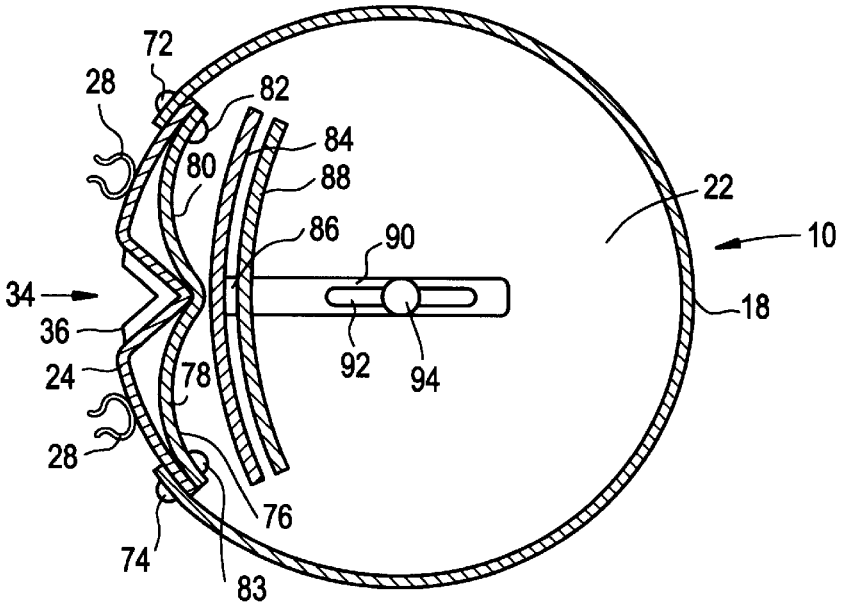
FIG. 3 shows a top sectional view of the embodiment of FIG. 1.
Figure 4:
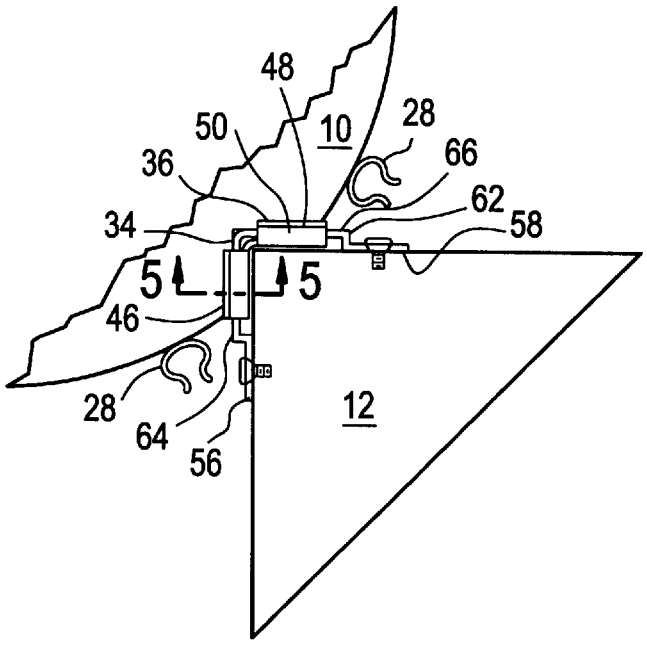
FIG. 4 shows a top view of the canister-corner attachment of the embodiment of FIG. 1.
Figure 5:
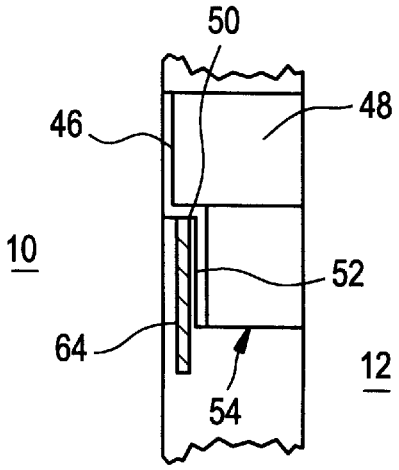
FIG. 5 shows a sectional side view of the canister-corner attachment of FIG. 4.
Figure 6:
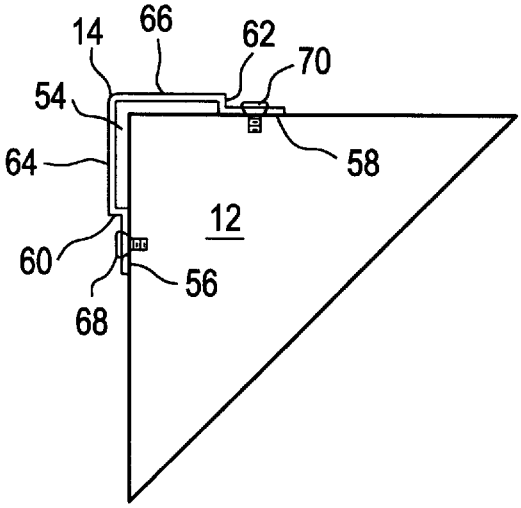
FIG. 6 shows a top view of the attachment of FIG. 4.

As shown in FIGS. 2, 3 and 7, a triple reflector system can be incorporated within the canister, lens 18 is attached to backpiece 24 by screws 72 and 74. Fixed reflector 76 which has two cusp like concave sections 78 and 80 closely fits against backpiece 24 conforming to groove 34, it is attached to backpiece 24 by screws 82 and 83. Adjustable reflectors 84 and 88 each with a single concave section have tongues 86 and 90, having longitudinal slots 92 engaged by screw 94 which is received in a threaded socket (not shown) associated with lower end cap 22. Each reflector 76, 84 and 88 subtend an angle of about 90° to the central axis of the canister passing through the vicinity of screw 94. As can be seen in FIG. 3, with lens 18 removed, screw 94 secures lower tongues 86 and 90 to lower end cap 22, while upper screw 194 similarly secures upper tongues 186 and 190 to upper end cap 20, light socket 42 is supported by bracket 96. In FIG. 7, omitting the canister, one reflector arrangement is shown with reflectors 84 and 88 pivoted about screws 94 and 194, to provide maximum reflector surface. As those skilled in the art will appreciate, either or both reflectors 84 and 88 can be easily moved by slackening screws 94 and 194, moving the adjustable reflector(s) to the desired position(s) and tightening screws 94 and 194.

Figure 8:
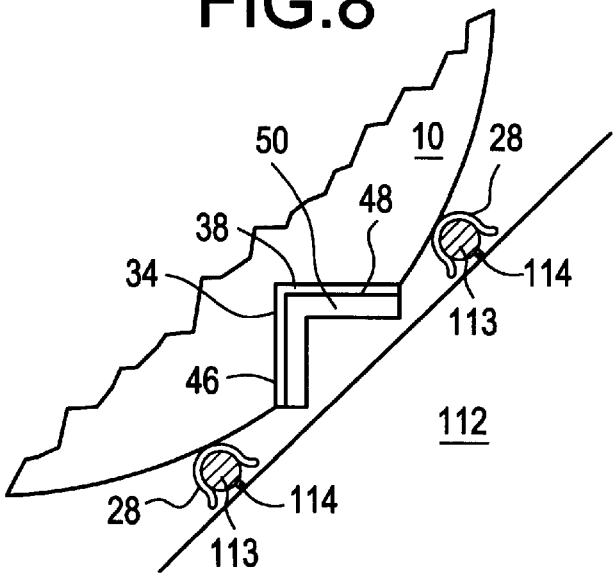
FIG. 8 shows a top sectional view of the canister-wall attachment of the embodiment of FIG. 1.

FIG. 8, shows attachment of canister 10, to flat wall 112, canister mounted spring clips 28, engage wall mounted vertical bars 113, attached by screws or bolts 114 to flat wall 112. Hook 38 is shown to indicate ease of attaching canister 10 to wall 112.

Figure 9:
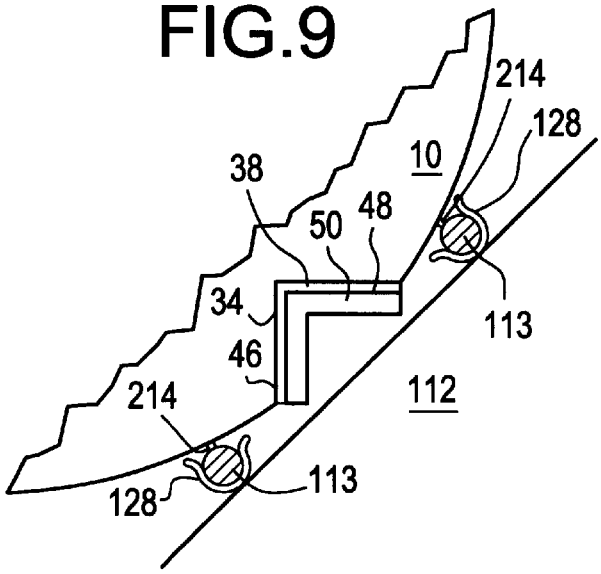
FIG. 9 shows a top sectional view of an alternative canister-wall attachment.

FIG. 9, shows an alternative attachment of canister 10, to flat wall 112, wall mounted spring clips 128, engage canister mounted vertical bars 113, attached by screws or bolts 214 to canister 10.

Figure 10:
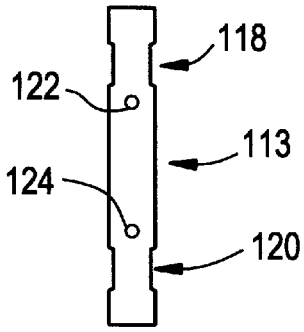
FIG. 10 shows an elevational view of a wall attachment bar of the invention.

FIG. 10 shows mounting bars 113, these are cylindrical having two peripheral grooves 118 and 120 to engage spring clips 28 and 128, and two diametric parallel holes 122 and 124 to receive screws or bolts 114 for wall attachment. Wall bars 113 are conveniently made from plastic.

As those skilled in the art would realize these preferred described embodiments can be subjected to substantial variation, modification, change, alteration, and substitution without affecting or modifying the function of the described embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. Light canister having opposed spaced apart top and bottom ends connected by a member forming a backpiece, and at least one adjustable reflector pivotally mounted in said top and bottom ends, and a socket to receive a light bulb mounted in one said end.

2. Canister of claim 1, wherein said socket is mounted in said top end.

3. Canister of claim 1, comprising attachments mounted on said backpiece to releasably engage attachments on a flat wall.

4. Canister of claim 1, wherein said at least one adjustable reflector comprises paired adjustable reflectors pivotally mounted in said top and bottom ends.

5. Canister of claim 4, wherein each said adjustable reflector has a reflecting surface member of concave horizontal cross section and upper and lower tongues means extending toward the middle of said canister, both said tongues having therein longitudinal slots overlapping an axis passing substantially through the middle of said top and bottom ends, and upper and lower screws passing through said slots and engaging said top and bottom ends and said paired adjustable reflectors extend from adjacent said top end to adjacent said bottom end, each said adjustable reflector subtending a horizontal angle of approximately a right angle to said axis.

6. Canister of claim 5, comprising attachments mounted on said backpiece to releasably engage attachments on a flat wall.

7. Canister of claim 6, wherein said attachments comprising a plurality of horizontal spring clips mounted on said canister to engage releasably a plurality of vertical bars mounted on said flat wall.

8. Canister of claim 1, comprising at least one fixed reflector interior and adjacent said backpiece forming a reflecting surface of biconcave horizontal cross section, and said at least one fixed reflector extends from adjacent said top end to adjacent said bottom end, said at least one fixed reflector subtending a horizontal angle of approximately a right angle to said axis.

9. Canister of claim 8, comprising attachments mounted on said backpiece to releasably engage attachments on a flat wall.

10. Canister of claim 9, wherein said attachments comprising a plurality of horizontal spring clips mounted on said canister to engage releasably a plurality of vertical bars mounted on said flat wall.

11. Canister of claim 1, wherein said backpiece comprises a groove extending vertically when said canister is mounted vertically, said groove having mounted therein at least one hook to engage at least one bracket mounted on a protruding corner.

12. Canister of claim 11, comprising attachments mounted on said backpiece to releasably engage attachments on said flat wall.

13. Canister of claim 5, comprising at least one fixed reflector interior and adjacent said backpiece forming a reflecting surface of biconcave horizontal cross section, and said at least one fixed reflector extends from adjacent said top end to adjacent said bottom end, said at least one fixed reflector subtending a horizontal angle of approximately a right angle to said axis.

14. Canister of claim 13, comprising a plurality of horizontal spring clips mounted on said canister to engage releasably a plurality of vertical bars mounted on a flat wall.

15. Light canister having opposed spaced apart top and bottom ends connected by a member forming a backpiece, and attachments mounted on said backpiece to releasably engage attachments on a flat wall, and a socket to receive a light bulb mounted in one said end.

16. Light canister of claim 15, wherein said attachments are selected from the group consisting of a plurality of horizontal spring clips mounted on said canister to engage releasably a plurality of vertical bars mounted on said flat wall, and a plurality of vertical bars mounted on said canister to engage releasably a plurality of horizontal spring clips mounted on said flat wall.

17. Canister of claim 15, wherein said attachments comprise a plurality of horizontal spring clip mounted on said canister backpiece to engage releasably a plurality of cylindrical bars mountable vertically on said flat wall.

18. Canister of claim 15, wherein said backpiece comprises a groove extending vertically when said canister is mounted vertically, said groove having mounted therein at least one hook to engage at least one bracket mounted on a protruding corner.

19. A kit comprising a light canister having opposed spaced apart top and bottom ends connected by a member forming a backpiece and a socket to receive a light bulb mounted in one said end, said backpiece comprises a groove extending vertically when said canister is mounted vertically, said groove having mounted therein at least one hook to engage at least one bracket mounted on a protruding corner, and a plurality of spring clips.

20. Kit of claim 19, additionally comprising a plurality of bars to engage releasably said plurality of spring clips, said bars being circumferentially grooved to receive said spring clips.

* * * * *